US005783045A

United States Patent [19]

Santos et al.

[11] Patent Number: 5,783,045

[45] Date of Patent: Jul. 21, 1998

[54] PULP AND LINERBOARD FORMER WITH IMPROVED DEWATERING

[75] Inventors: Gilmar M. Santos, Campinas, Brazil; Cornelius Neil Rempel, Beloit, Wis.

[73] Assignee: Beloit Technologies, Inc., Wilmington, Del.

[21] Appl. No.: 643,557

[22] Filed: May 6, 1996

[51] Int. Cl.[6] ..... D21F 1/00

[52] U.S. Cl. ..... 162/301; 162/300; 162/360.2; 100/118; 100/153

[58] Field of Search ..... 162/203, 205, 162/210, 300, 301, 305, 360.2; 100/118, 153

[56] References Cited

U.S. PATENT DOCUMENTS

| | | | |
|---|---|---|---|
| 1,925,972 | 9/1933 | Standley et al. | 162/360.2 |
| 2,141,393 | 12/1938 | Hutchins | 162/300 |
| 2,730,933 | 1/1956 | Reynolds | 162/301 |
| 2,821,120 | 1/1958 | Thomas et al. | 162/301 |
| 2,881,668 | 4/1959 | Thomas | 162/301 |
| 2,881,669 | 4/1959 | Thomas et al. | 162/301 |
| 2,881,675 | 4/1959 | Thomas | 162/301 |
| 2,881,676 | 4/1959 | Thomas | 162/301 |
| 3,796,148 | 3/1974 | Heissenberger | 100/118 |
| 3,796,149 | 3/1974 | Heissenberger | 162/360.2 |
| 3,906,853 | 9/1975 | Wohlfarter | 100/118 |
| 4,544,447 | 10/1985 | Pinter et al. | 162/300 |
| 4,544,448 | 10/1985 | Lintunen | 162/301 |
| 4,714,521 | 12/1987 | Fujiwara | 162/300 |
| 4,917,766 | 4/1990 | Koivuranta et al. | 162/300 |
| 5,085,737 | 2/1992 | Brogyanyi et al. | 162/301 |
| 5,167,770 | 12/1992 | Bubik et al. | 162/301 |
| 5,282,933 | 2/1994 | Bubik et al. | 162/301 |
| 5,389,206 | 2/1995 | Buck et al. | 162/301 |

FOREIGN PATENT DOCUMENTS

| | | | |
|---|---|---|---|
| 392 304 B | 3/1991 | Austria | D21F 2/00 |
| 0 373 133 A2 | 6/1990 | European Pat. Off. | D21F 1/48 |
| 0 405 154 A1 | 1/1991 | European Pat. Off. | D21F 1/48 |
| 823643 | 1/1984 | Finland | 162/301 |
| 3138133 | 3/1983 | Germany | 162/301 |
| 592904 | 2/1978 | U.S.S.R. | 162/301 |
| 94/29519 | 12/1994 | WIPO | 162/210 |

OTHER PUBLICATIONS

*"Beloit Tetraformer™ Twin Wire Former–A new former for pulp processing,"* Beloit Corporation, Beloit, Wisconsin, Nov. 1995.

*Primary Examiner*—Karen M. Hastings
*Attorney, Agent, or Firm*—Lathrop & Clark

[57] ABSTRACT

In a twin wire former a headbox injects stock onto a forming wire with which a second forming wire is brought into gradual engagement. A forming shoe directs the two wires along a path of increasing curvature, above which water is drained by adjustable auto slices. The two wires with the web therebetween then follow an oscillating S-shaped path between seven S-rolls and are directed upwardly through three individually loaded press rolls with increasing pressure to about four hundred and fifty pounds per linear inch at the last wet press. Drainage pans collect water from the upper surface of the twin wires and water thrown off the upper press rolls. The press rolls are individually pneumatically pivotable to increase nip pressure, and collectively pivotable to open all the nips. Next a high pressure dry nip can increase the fiber content of the web to thirty-five percent fiber.

2 Claims, 4 Drawing Sheets

PULP AND LINERBOARD FORMER WITH IMPROVED DEWATERING

FIELD OF THE INVENTION

The present invention relates to paper forming sections in a papermaking machine in general and to twin wire formers in particular.

BACKGROUND OF THE INVENTION

Paper is generally manufactured from wood or other plant fiber. The process is capital intensive and involves many discrete processes which require specialized machinery. Ideally a papermaking plant will be located next to a good supply of raw material—for example a pulpwood forest. On the other hand it is advantageous to have the papermaking plant located near the customers for finished paper. Being located physically near the end customer facilitates supply of undamaged goods and improves communications between the manufacturer and the end user. Many countries or geographical locations which have plentiful supplies of pulpwood or other fiber-producing plants such as bamboo or hemp lack the capital needed to construct a paper manufacturing facility. Further, local demand for paper may be insufficient to support a local papermaking industry. At the same time a country or fiber-producing region which may find it uneconomical to develop a papermaking industry, may desire to increase the value of locally produced resources before exporting them.

One workable compromise is for the producer of the raw plant material such as wood logs to convert the raw fibers into fiber ready for the production of paper. Performing the pulping step of the papermaking process locally and selling papermaking fiber adds value to the locally produced resources. At the same time, because the fiber is concentrated the cost of shipping a unit of fiber is reduced. In this way a greater share of the value of the end product, paper, remains with the country or region where the wood fibers originate.

In order to economically ship the fibers they must be concentrated from the water based stock which results from the pulping process. Thus devices are needed which remove as much water from the fibers as is cost-effectively possible.

Drying pulp is an energy-intensive process and the cost of generating the necessary heat and motive power is a significant factor in the overall cost of making paper. Considerable cost can be saved if the amount of water which must be removed through heating in the drying section is reduced. This is accomplished by improving the water removal capabilities of the forming and pressing sections ahead of the drying section in the papermaking machine.

Within the forming section the removal of water from the web is normally accomplished through extensive use of vacuum to draw water from the fiber mat as it forms on the forming wire or wires of the forming section. The need to generate large flows of reduced pressure air consumes considerable energy. Nonetheless, typically the need to remove more water more rapidly in the forming section has led to the greater use of vacuum in the forming section.

Improved forming apparatus which increases the fiber content of the formed web while reducing the use of energy intensive vacuum dewatering aids would be advantageous not only for production of pulp but also would be advantageous in forming linerboard.

SUMMARY OF THE INVENTION

The forming section or machine of this invention is of the twin wire type. A headbox injects a stream of stock onto a forming wire. Bars or blades positioned beneath the forming wires create hydrodynamic forces which draw water out through the bottom of the wire. After the stock has been so dewatered that flow of stock towards the edges of the forming wire is no longer possible, a second wire is brought into gradual engagement with the forming wire and the two wires are caused to follow a curved path over a forming shoe. The curved path begins with a radius of five hundred inches and the curvature increases to a radius of one-hundred inches. The curvature is supported by forming shoes which direct the two wires along the increasing curvature thus providing a gradual nip pressure increase. The blades making up the forming shoes may have varied spacing between them and can be used with or without vacuum and opposed blades. Above the curved-shoe-formed path, water is drained through the second wire by adjustable auto slices that may employ one or multiple slots. The auto slices are adjustable by raising and lowering the drainage slots with respect to the upper wire. The upper wire feed roller is adjustable in the vertical plane to provide control of the point of contact between the top wire and the web supported on the bottom wire. Controlling the point of contact can be used to increase or decrease the rate of drainage of the web.

Following the drainage shoes seven S-rolls are arrayed, four above the top wire and three beneath the bottom wire. The S-rolls are arranged to cause the two wires with the web therebetween to follow an oscillating or S-shaped path. The amount of wrap onto the S-rolls can be controlled so that the drainage pressure on the wires increases gradually. Doctor blades on each S-roll prevent the buildup of fibers on the roll surfaces and can be used to remove water from the S-rolls as well. The S-rolls can be plain, grooved, blind drilled or of open construction.

The two wires enclosing the web are directed upwardly through three individually loaded press rolls. Pressure is gradually increased from zero before entering the first press roll to about four-hundred-and-fifty pounds-per-linear-inch in the third press. The upward slope of the wires through the press rolls facilitates water removal from the top wire by cross machine drainage pans which collect water from the upper surface of the twin wires. These pans also collect water which is thrown off the upper press roll. Each upper press roll is mounted on a pivoting bracket which has an upwardly extending arm. Each arm is mounted to a pneumatic actuator or air ride which moves the arm to supply pressure to the nip between the press rolls with the mechanical advantage provided by the lever. The nips are each individually controlled but are linked together so a single air ride can open all the nips. Following the wet nips a high pressure dry nip which is loaded as high as one-thousand pounds-per-linear-inch can increase the fiber content of the web to thirty-five percent.

It is a feature of the present invention to provide a pressing section for production of pulp and linerboard which operates without vacuum.

It is another feature of the present invention to provide a forming section of a papermaking machine which can produce a web with a thirty-five percent fiber dry weight content.

It is a further feature of the present invention to provide a lower cost more compact pressing section for a papermaking machine.

It is yet another feature of the present invention to provide a twinwire former which requires reduced levels of maintenance.

Further objects, features and advantages of the invention will be apparent from the following detailed description when taken in conjunction with the accompanying drawings.

DESCRIPTION OF THE PREFERRED EMBODIMENT

Figure 1:
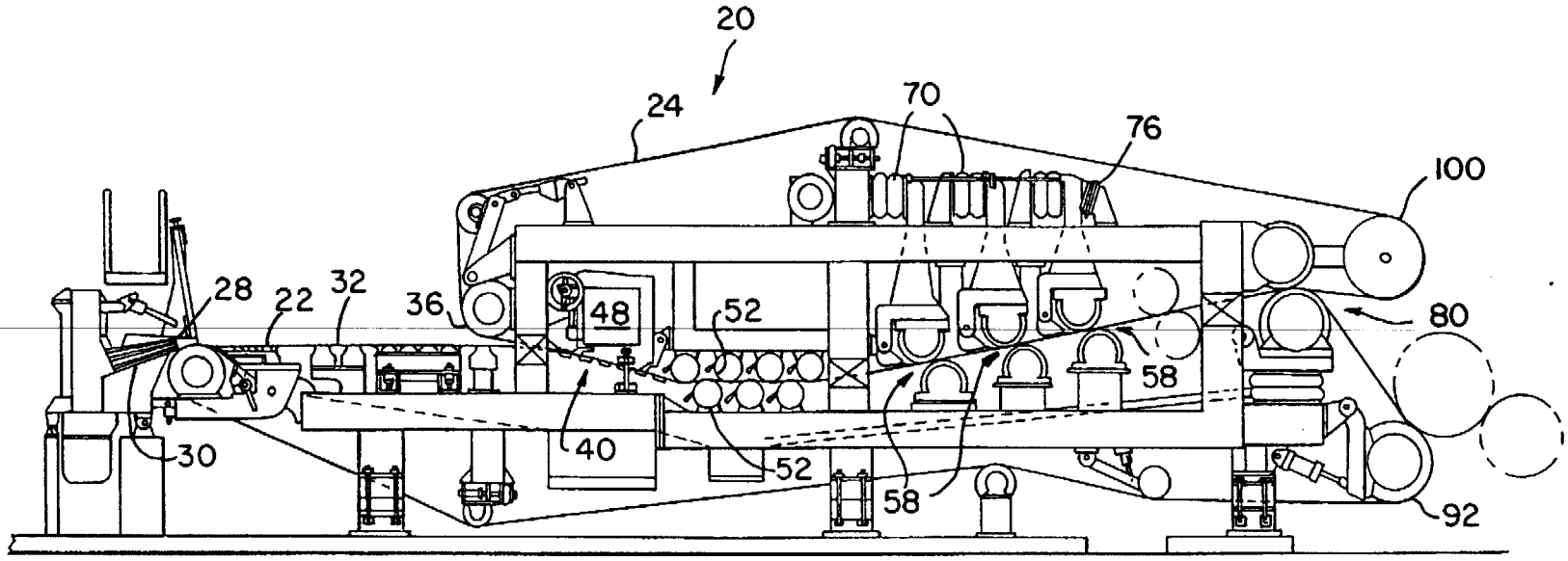
FIG. 1 is a schematic side elevational view of the forming section of a papermaking machine of this invention.
Figure 2A:
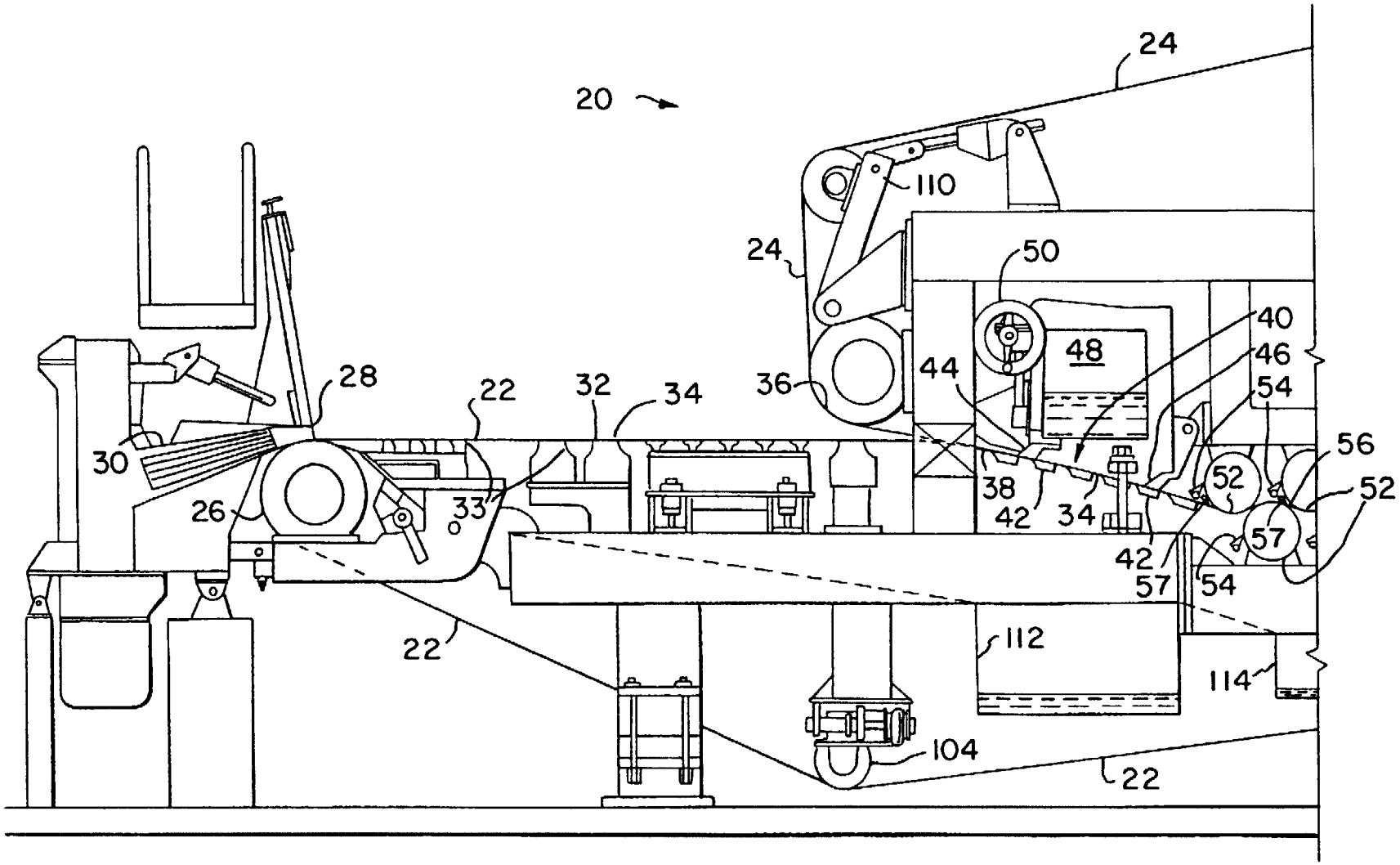
FIG. 2A is an enlarged partial side elevational view of the forming section of FIG. 1
Figure 2B:
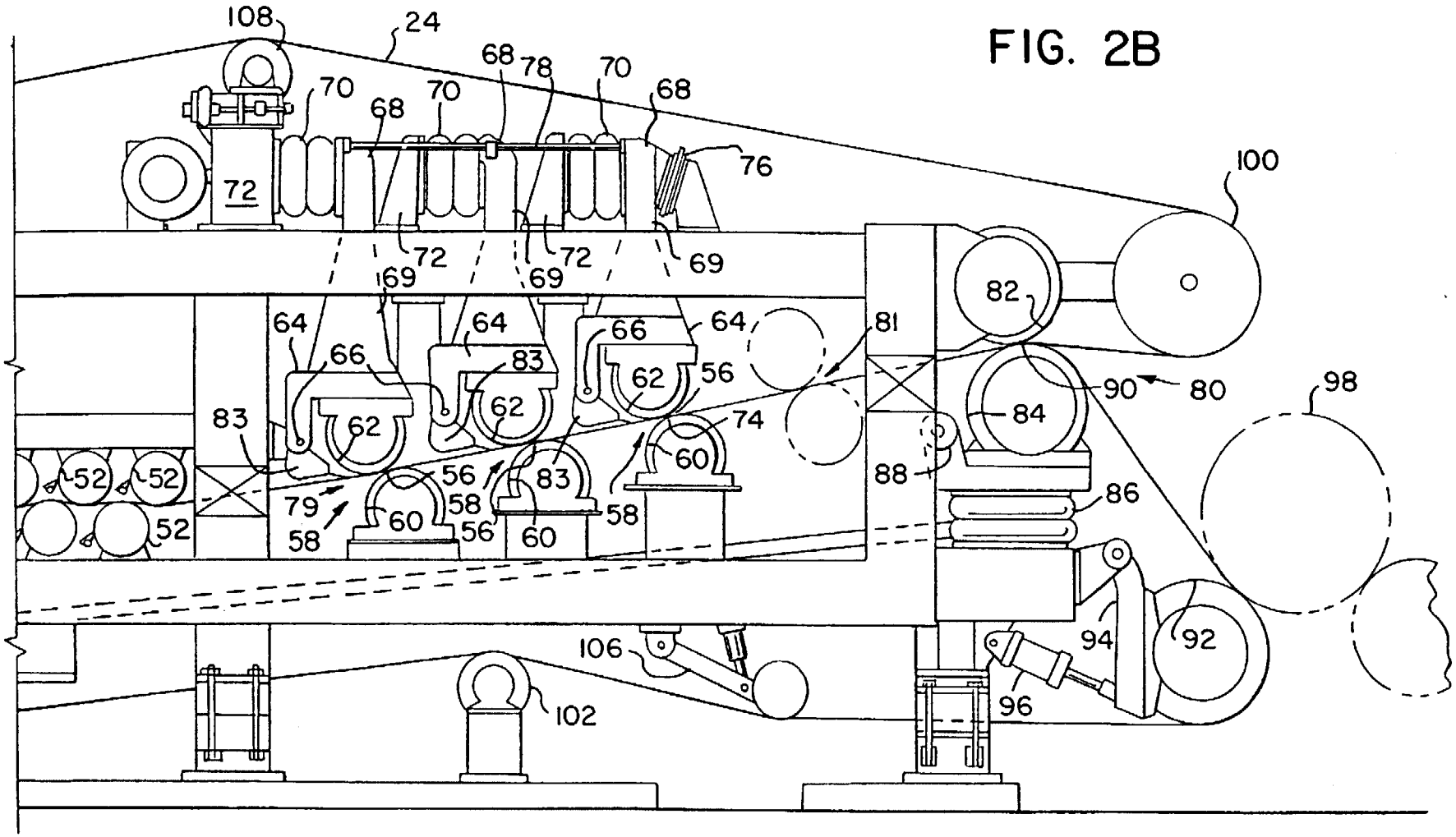
FIG. 2B is an enlarged partial side elevational view of the forming section of FIG. 1 which when joined with FIG. 2A forms an enlarged view of FIG. 1.
Figure 3:
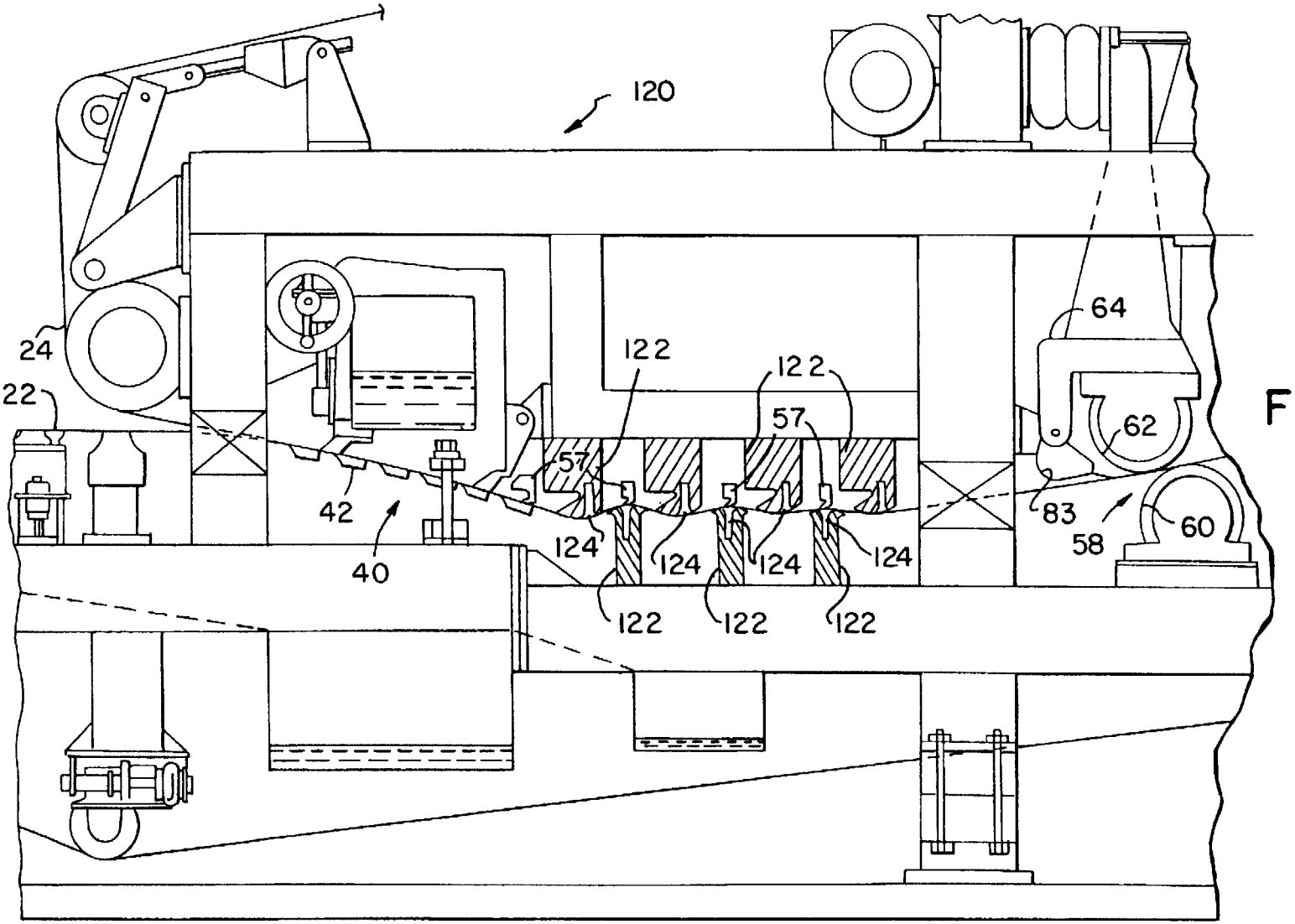
FIG. 3 is a fragmentary view of an alternative embodiment forming section of this invention in which the S-rolls are replaced with fixed members.

Referring more particularly to FIGS. 1–3, wherein like numbers refer to similar parts, a forming section or former 20 of a papermaking machine is shown in FIG. 1. The forming section 20 is of the twin wire type having a lower forming wire 22 onto which the stock is deposited and which is brought together downstream with an upper forming wire 24 for treatment at several dewatering stages. The lower forming wire 22 moves around a breast roll 26 where a stream of stock is deposited from a headbox 30 slice opening or lip 28. The stock deposited onto the lower wire is of relatively high consistency, for example about 1.3 percent dry fiber by weight. The lower wire 22 travels over a forming table 32 where the dewatering of the stock begins.

A series of hydrofoils or bars 33 are positioned below the lower wire 22. The bars 33 aid the drainage of the stock by creating regions of low pressure which draw the whitewater from the stock and form a web 34 on the lower wire 22. The bars 33 can be constructed of high density polyethylene or ceramic material. Furthermore, the bars 33 may have improved performance if the leading edges of the bars are closer to the underside of the lower forming wire 22 than the trailing edges. Positioning the leading edges of the bars 33 can be accomplished by a slight taper or relief on the downstream side of the bars.

In a typical twin wire former tapered deckles or dams are required to prevent the stock from flowing towards the edges of the wires. In the former 20 the web is sufficiently dry when the upper wire 24 is brought into engagement with the lower wire that high maintenance tapered deckles are not required. A lead roll 36 is positioned above the upper forming wire 24 and directs it into engagement with the web 34 on the lower forming wire 22. The lead roll 36 will preferably be adjustable, typically by slotted bolt holes to allow adjustment of a contact line 38 between the upper and lower wires 22, 24. In this way the contact line 38 can be adjusted to assure that the web is sufficiently dewatered before being pressed between the upper wire 24 and the lower wire 22.

After the upper and lower wires 24, 22 meet at the contact line 38 they are lead over a forming shoe 40 formed by a plurality of blades or shoes 42 which cause the wire to move along a curved path. The forming shoe 40 has a radius of curvature of between one-hundred and five-hundred inches depending on the speed of the machine 20. The faster the wire speed the more gradual the curve needed to remove water from the top side of the upper wire 24. Causing the wire to move in a curved path utilizes centrifugal force to move water up from the web 34 through the top wire 24.

The web is dewatered from above by a first auto slice 44 and a second auto slice 46. The auto slices 44, 46 consist of narrow cross machine direction extending slots that draw water from the upper surface of the upper wire and supply the water to a saveall 48. The positioning of the first auto slice 44 may be adjusted by a hand wheel 50 for optimal positioning over the upper wire 24.

Upon leaving the forming shoe 40 the opposed upper and lower wires 24, 22 pass through a series of S-rolls 52. As shown in FIG. 1 the S-rolls 52 are arranged so that four S-rolls engage the top of the upper wire 24 and three S-rolls engage the bottom of the bottom wire 22. The S-rolls 52 cause the two wires with the web 34 therebetween to be subjected to increased draining pressure. The amount of wrap of the twin wires is controllable by adjusting each S-roll 52 to get the desired wrap. The S-rolls 52 may be plain or may, particularly in the case of the lower S-rolls, be grooved, blind drilled, or of open construction. Each S-roll 52 has a doctor blade 54 which prevents a buildup of fibers on the S-roll and provides drainage into a saveall. Because water may pool in front of the nips 56 formed by the S-rolls 52, small auto slices 57 may be required or advantageous in front of at least the first one or two S-rolls to reduce puddling in front of the upper S-rolls.

Upon leaving the S-rolls 52 the upper wire 24 and the lower wire 22 with the web held between are directed upwardly through three progressive presses 58. As shown in FIG. 2B, the presses 58 have fixed axis lower rolls 60 and pivotable axis upper movable rolls 62 which are mounted on pivoting brackets 64. The upper rolls 62 are offset towards the headbox 30 so the wires 22, 24 with the web between them wrap the upper rolls 62 and the lower rolls 60 approximately 15 degrees. Each upper roll 62 is mounted to the former frame 72 by a pivot 66 on the pivot bracket 64 so that motion of the upper end 68 of an upwardly extending arm 69 of each bracket 64 results in mechanical advantage in moving the upper rolls 62 against the lower rolls 60. Air rides 70 are mounted between the former frame 72 and the bracket arm upper ends 68 to load the nips 56 formed by the upper 62 and lower 60 press roll. The air rides 70 may be similar to the rubber tire-type air supports used in heavy trucks.

Air under pressure is supplied to the air rides 70 to cause them to extend and so move the pivot brackets 64 about their pivots 66 to close the press nips 56. Each nip 56 is controlled by a bracket 64 with its own air ride 70 so that the pressure in each nip may be controlled. The nip pressures are increased until the third nip 74 has a load of about 450 lb per linear inch in the cross machine direction. The air rides 70 do not operate to open the nips 56. To open the nips simultaneously an opening air ride 76 is linked to a bar 78 which is linked to each arm 69. Actuation of the opening air ride 76 causes each arm 69 to move towards the headbox thereby opening all three nips 56 at once. Opening the nips 56 is necessary when a forming wire is being replaced. The nip pressures may be varied to suit the particular pulp or linerboard being formed, but in an exemplary pulp forming application, the pressure in the first nip is about 40–50 kN/m, in the second nip about 60–70 kN/m, and in the third nip about 80–90 kN/m. If a fourth nip is employed a pressure of 100–110 kN/m may be used.

The pressure developed in each wet press nip 56 is selected with the particular stock being formed in mind. Some stocks may require zero pressure in the first wet press 79 in order to avoid crushing or over-compacting the web. If necessary, a fourth wet press 81, shown in phantom view in FIG. 1, may be used. Each wet press nip 56 is individually controllable and the twin wires are wrapped onto the upper rolls 62 first so that dewatering takes place through the upper wires 24 where the upward slope of the wires through the press rolls facilitates water removal from the top wire 24 by cross machine drainage pans 83 which collect water from the upper surface of the twin wires. The pans also collect water which is thrown off the upper press rolls.

As shown in FIG. 2B a final press 80 is formed between an upper press roll 82 and a lower press roll 84. This final press 80 is loaded through an air ride 86 positioned beneath the lower press roll 84. The lower press roll 84 is mounted on a pivot bracket 88. Because the air ride 86 is positioned beneath the roll 84, gravity will open the nip 90 of the final press when pressure is removed from the lower air ride 86. The pressure of the final press 80 is about one thousand lbs per linear inch in the cross machine direction.

The final press 80 can increase the fiber content of the web to thirty-five percent with some furnishes. This is as good as a conventional pressing section using two or three presses. One area of concern with the final press 80, is the wear caused by pressing on the forming wires 24, 22. Thus the final press rolls 82, 84 should have a rubber surface with a Paussey and Jones hardness of 15 to 18. A polyurethane type covering may also be effective.

If the former 20 is used for pulp production the final press 80 may have driven upper and lower rolls 82, 84 which will be the only driven rolls in the former 20. If the former 20 is used for the production of linerboard or some grades of pulp, a turning roll 92 may follow the lower roll 84 of the final press 80. The turning roll 92 as shown in FIG. 1 is mounted on a pivot bracket 94 where a hydraulic cylinder 96 can move the roll 92 against a press roll 98. If a turning roll 92 is used the turning roll may be driven instead of the lower press roll 84. In a similar manner, a top roll 100 is shown in FIG. 1 leading the top wire 24 away from the top press roll 82. The top roll 100, if used, may also be driven instead of the upper press roll 82. The employment of a top roll 100 and a turning roll 92 reduces the wrap angle on the rolls making up the final press 80. The rolls 92, 100 allow better sheet transfer, and also permit the use of crowned rolls in the final press 80.

When forming pulp on the former 20 the press roll 98 does not engage the lower wire 22 or the turning rolls 92 but transfers the web 34 across a small open draw. On the other hand where linerboard is being produced on the former 20 the press roll 98 may form a press nip with the turning roll 92. The press roll 98 may be a vacuum roll to facilitate transfer of the web to the pressing section.

After the lower wire 22 leaves the final press 80 and turns around the turning roll 92, if present, the wire returns to the breast roll 26 by way of two return support rolls 102, 104. A tensioning arm 106 pivotally engages the wire 22 to control tension in the lower wire 22. Similarly the upper wire 24 after passing over the upper final press roll 82 and the top roll 100, if present, returns to the lead roll 36 by way of a top return support roll 108. A top tensioning arm 110 controls the tension in the top wire 24. Controlling the wire tension in the upper and lower wires 24, 22 is critical to controlling the dewatering taking place in the S-rolls 52.

A whitewater tray 112 is positioned beneath the forming shoe 40 and receives water from between the breast roll 26 and the forming shoe 40. A second whitewater tray 114 is positioned beneath the S-rolls 52 and receives whitewater from the former 20 downstream of the S-rolls 52.

In a preferred embodiment no vacuum pumps are required since there are no flat boxes or suction rolls. Consequently, air which normally cools the pulp web is not drawn through the web. Therefore, hot water or steam is not required for web heating with consequent energy savings and reduced investment costs.

An alternative embodiment former 120 is shown in FIG. 3 which replaces the S-rolls 52 with stationary members or elements 122. The former 20 showed in FIG. 1 has a cross machine width of about one-hundred-and-fifty inches. As machine width is increased the rolls must be of greater diameter to achieve greater stiffness. As the S-rolls increase in size the desired sinuous path required for dewatering is harder to achieve. The use of stationary elements 122 which are rigidly supported allows the desired sinuous path to be maintained despite increased machine width. The stationary elements have radiused surfaces which engage the wires. By selecting the radius of the stationary element surfaces the nip pressure between the wires may be controlled. The stationary elements 122 may readily have cross machine direction vacuum slots 124 for dewatering the web 34. An auto slice 57 may also be used to remove water which puddles in front of the stationery elements 122.

It should be understood that the S-rolls may be plain, grooved, blind drilled or of open construction. The press rolls 60, 62 may be plain, grooved, or blind drilled and the final press rolls 82, 84 may similarly be plain, grooved, or blind drilled.

It should also be understood that the former 20 achieves substantial cost savings by eliminating the use of vacuum to dewater the web 34. However most of the cost advantages of the former 20 are achieved if at least a majority of the water is removed without the use of vacuum. Some incidental use of vacuum not for removing water from the web but for collecting water which has already been pressed or otherwise removed from the web 34 is beneficial. For example water is drawn into the auto slices 44, 46 or from the auto slice 57 in front of the S-rolls 52 of FIG. 1 or the stationary elements 122 shown in FIG. 3.

It should be understood that after leaving the forming section 20 the web 34 enters a pressing section. In the pressing section the fiber content of the web is increased to about 50 percent fiber. A dryer section completes the drying of the web to about 95 percent fiber. Sheet quality in terms of fiber orientation is important even when forming pulp because differential shrinkage of the pulp sheet can impede drying the web in the dryer section. Where a turning roll 92 is used for pulp forming the turning roll 92 does not engage the first press section roll. On the other hand, where linerboard is being formed the turning roll may be of larger size to engage the first pressing felt forming a press with the first press roll.

In addition, it should be understood that the amount of wrap of the wires 22, 24 on the S-rolls 52 can be varied but will typically remain constant as the web moves through the S-rolls with increased pressure resulting from the reduced water content of the web 34 as it progresses through the S-rolls. Similarly the amount of the wrap on the press rolls 82, 84 can be varied between 0 and 30 degrees with 15 being reasonably optimum and with the amount of wrap depending on the furnish of the paper being formed.

It should also be understood that a water shower of perhaps 200 to 300 psi pressure can be used on the bottom press roll 84 or where a turning roll 92 is used on the lower wire between the bottom roll 84 and the turning roll 92, to trim the web 34. The trimmed web is not picked up by the forming felt and drops down into a repulping collector.

The former 20 has a nominal operating web speed in the range of 90 to 150 meters per minute and a nominal width of 150 inches. Wider machines are possible by implementing stationary elements 122 as shown in FIG. 3 and by using crowned press rolls or even using crown control rolls, although crown control rolls increase the cost of the former.

It is understood that the invention is not limited to the particular construction and arrangement of parts herein illustrated and described, but embraces such modified forms thereof as come within the scope of the following claims.

We claim:

1. A forming apparatus configured for forming a linerboard web, the apparatus comprising:

a headbox having a slice opening;

a first wire traversing a breast roll positioned beneath the slice opening, wherein the first wire passes over a forming table;

a web formed from stock ejected from the headbox and draining on the first wire as the web passes over the forming table, the web defining a position on the first wire where the web is sufficiently dewatered to prevent a flow of stock within the web;

a second wire positioned above the first wire and passing over a top roll positioned above the first wire and spaced downstream of the forming table, wherein the second wire passes over the top roll and approaches the first wire and the web, and wherein the second wire engages the web substantially at the position defined by the web where the web is sufficiently dewatered to prevent a flow of stock within the web;

a forming shoe engaged with the first wire and the second wire and the web therebetween and causing the wires to follow a curved path;

a saveall positioned above the second wire as it passes over the shoe, the saveall positioned to remove water which passes upwardly through the second wire;

a plurality of rolls positioned above and below the first and second wires and the web therebetween, the rolls positioned to cause the web and the first wire and the second wire to traverse a sinuous path through the rolls and thereby wrap a portion of each roll surface;

at least three presses positioned downstream of the plurality of rolls, wherein each press has an upper press roll which is offset in the machine direction and towards the headbox from a lower press roll to form a nip therebetween, the press rolls being offset so the first and second wires wrap about 15 degrees of each upper press roll;

the at least three presses including a final press having two rolls which form a nip and defines the end of a joint run of the first and second wires, a second top roll contained within the second wire; and a turning roll contained within the first wire, the second top roll and the turning roll being spaced apart from one another and downstream of the final press to limit the amount of wrap of the wires on the final press rolls so that the amount of wrap of the final upper press roll is about fifteen degrees.

2. A forming apparatus configured for forming a linerboard web, the apparatus comprising:

a headbox having a slice opening;

a first wire traversing a breast roll positioned beneath the slice opening, wherein the first wire passes over a forming table;

a web formed from stock ejected from the headbox and draining on the first wire as the web passes over the forming table, the web defining a position on the first wire where the web is sufficiently dewatered to prevent a flow of stock within the web;

a second wire positioned above the first wire and passing over a top roll positioned above the first wire and spaced downstream of the forming table, wherein the second wire passes over the top roll and approaches the first wire and the web, and wherein the second wire engages the web substantially at the position defined by the web where the web is sufficiently dewatered to prevent a flow of stock within the web;

a forming shoe engaged with the first wire and the second wire and the web therebetween and causing the wires to follow a curved path;

a saveall positioned above the second wire as it passes over the shoe, the saveall positioned to remove water which passes upwardly through the second wire;

a plurality of stationary elements spaced from each other in the machine direction and alternately positioned above and below the first and second wires, and the web therebetween, the stationery elements positioned to cause the web and the first wire and the second wire to traverse a sinuous path through the elements and thereby wrap a portion of each element surface;

at least three presses positioned downstream of the plurality of rolls, wherein each press has an upper press roll which is offset in the machine direction and towards the headbox from a lower press roll to form a nip therebetween, the press rolls being offset so the first and second wires wrap about 15 degrees of each upper press roll;

the at least three presses including a final press having two rolls which form a nip and defines the end of a joint run of the first and second wires, a second top roll contained within the second wire; and a turning roll contained within the first wire, the second top roll and the turning roll being spaced apart from one another and downstream of the final press to limit the amount of wrap of the wires on the final press rolls so that the amount of wrap of the final upper press roll is about fifteen degrees.

* * * * *